US005445596A

United States Patent [19]

Grace

[11] Patent Number: 5,445,596

[45] Date of Patent: Aug. 29, 1995

[54] LOTION APPLICATOR AND MASSAGE DEVICE

[76] Inventor: James M. Grace, 3206 X Ave., Elberon, Iowa 52225

[21] Appl. No.: 271,896

[22] Filed: Jul. 8, 1994

[51] Int. Cl.[6] ..... A65D 34/00; A61H 7/00

[52] U.S. Cl. ..... 601/154; 401/46; 401/149

[58] Field of Search ..... 601/154, 159, 111, 93, 601/95, 155; 401/6, 44, 46, 47, 146, 149, 150

[56] References Cited

U.S. PATENT DOCUMENTS

| | | | |
|---|---|---|---|
| D. 353,223 | 12/1994 | Moore | 401/6 |
| 565,475 | 8/1896 | Lindahl | 601/111 |
| 1,574,418 | 2/1926 | Coviello | 601/154 |
| 1,623,124 | 4/1927 | Laufe | 601/135 |
| 1,974,031 | 9/1934 | Merrill | 601/154 |
| 2,303,667 | 12/1942 | Taborski | 601/163 |
| 3,416,517 | 12/1968 | Adams | 601/159 |
| 4,861,180 | 8/1989 | Adams | 401/6 |
| 4,896,984 | 1/1990 | Evans | 401/6 |

FOREIGN PATENT DOCUMENTS

| | | | |
|---|---|---|---|
| 117204 | 4/1930 | Germany | 601/111 |

*Primary Examiner*—Robert A. Hafer
*Assistant Examiner*—David J. Kenealy

[57] ABSTRACT

The device of the invention includes an elongate shaft having a shaft first end spaced from a shaft second end, with the shaft first end having a hand member, the hand member having a plurality of finger members extending therefrom, with outlet ports extending from the hand member in fluid communication with a reservoir, such that the reservoir permits pumping of fluid through the elongate shaft and subsequently through the outlet ports. The invention is arranged to further include a secondary conduit in fluid communication with a secondary reservoir, that in turn pumps fluid through the secondary conduit and through the hand member, with the hand member having finger members, each of the finger members including a secondary outlet port, and each secondary outlet port in fluid communication with the secondary conduit. The device further includes a drive motor having a flexible crank shaft to permit oscillation of rod members, with each of the rod members extending through an individual of the fingers to effect oscillation of the individual fingers for enhanced massaging action.

2 Claims, 4 Drawing Sheets

LOTION APPLICATOR AND MASSAGE DEVICE

TECHNICAL FIELD

The field of invention relates to massage and lotion application structure, and more particularly is related to a lotion applicator and massage device wherein the same permits the massaging of an individual's back as well as the application of lotion thereto.

BACKGROUND OF THE INVENTION

Massage devices have been utilized such as indicated in U.S. Pat. No. 4,915,096 wherein a back scratcher and body massager is provided, such that hook and loop fastener structure is employed as a massage and back scratching structure.

Reference to U.S. Pat. No. 5,240,339 is directed to a body lotion applicator having applicator head formed of a foam-like material permitting the application of lotion through the applicator head in an associated shaft structure.

SUMMARY OF THE INVENTION

The present invention relates to back massage and lotion applicator structure setting forth the use of the functions in a unitary construction, such that a remote reservoir permits pumping of fluid through a shaft structure directing the fluid through a hand member having individual finger members, with the lotion arranged for application to an individual's body through openings in the back of the hand structure and optionally through the fingertips. Further, the organization may provide for a massage structure permitting oscillation of the fingers to enhance massaging.

Objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
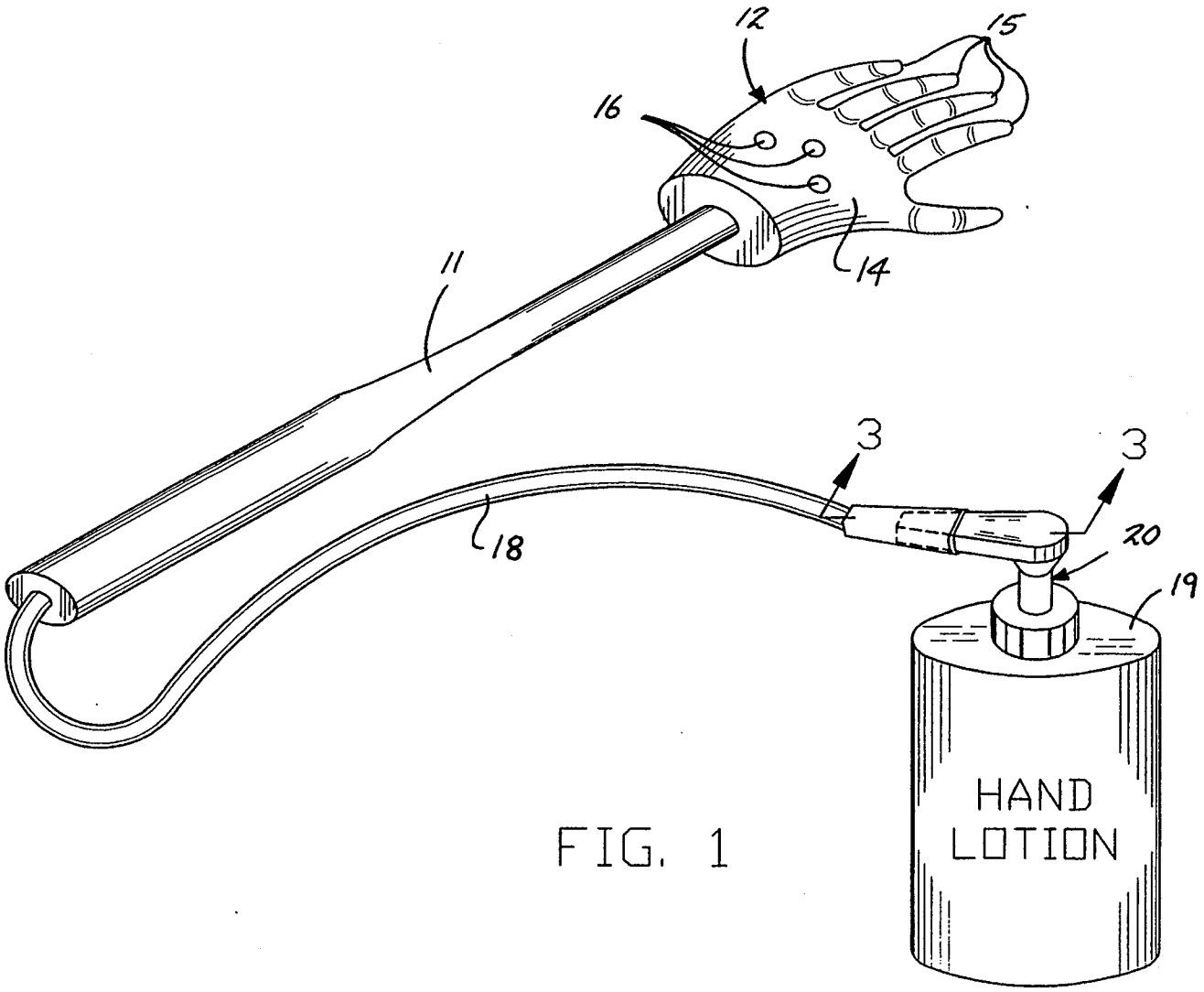
FIG. 1 is an isometric illustration of the invention employing a single reservoir.
Figure 2:
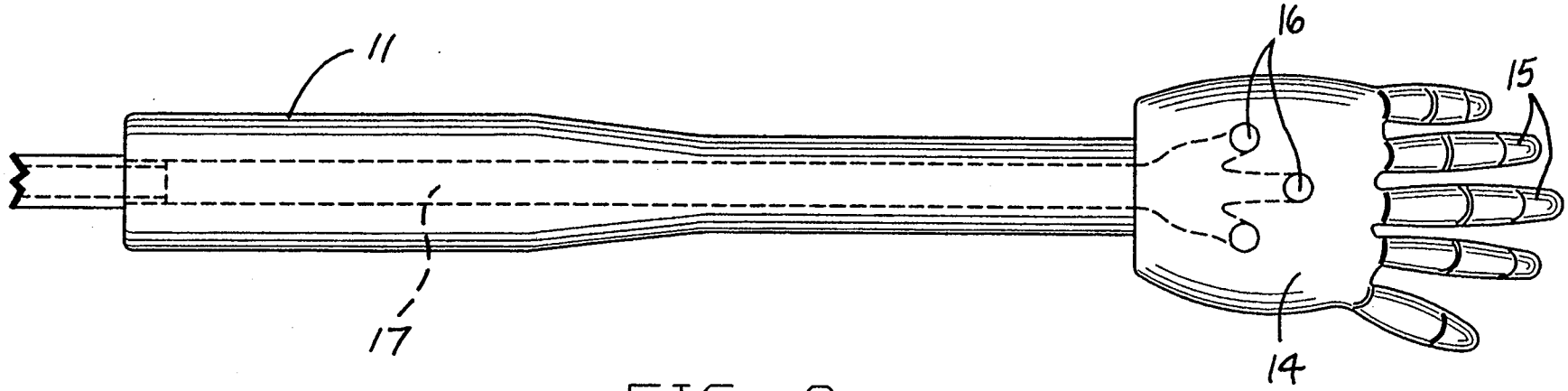
FIG. 2 is an orthographic top view of the invention, as indicated in FIG. 1.
Figure 3:
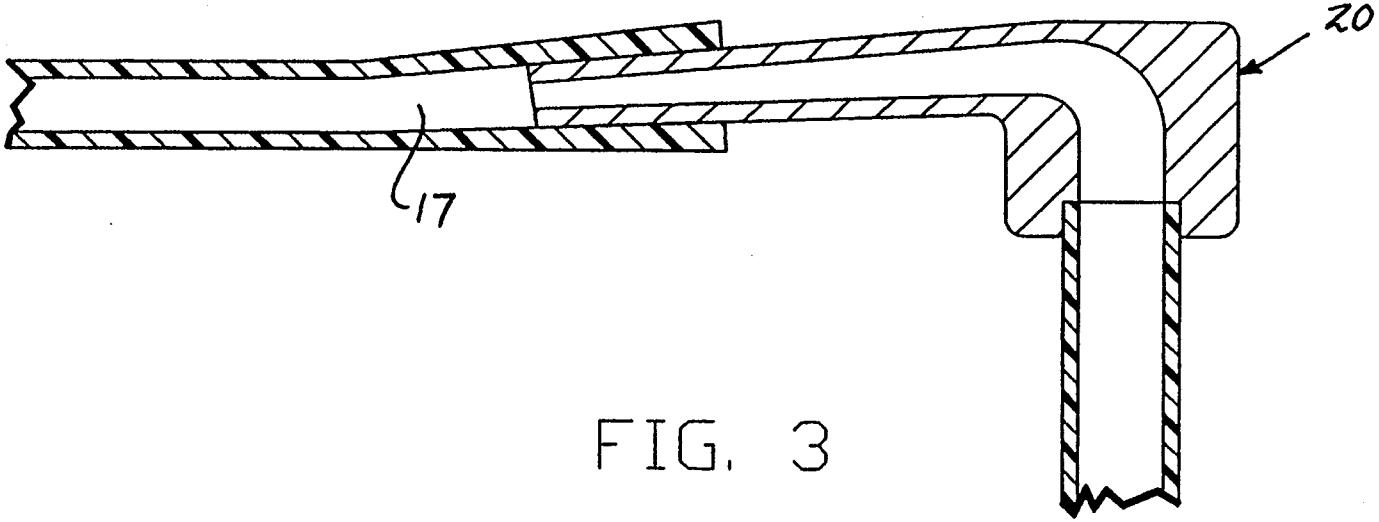
FIG. 3 is a sectional view, taken along the lines 3—3 of FIG. 1 in the direction indicated by the arrows.

FIG. 1 illustrates the device having an elongate shaft 11 terminating in a hand member 12 formed with a palm surface 13 and a back surface 14, with finger members 15 extending from the hand member, with the finger members arranged for use in a back scratching mode, such that a primary conduit 17 (see FIG. 2) directed through the shaft permits the flow of fluid such as hand lotion from the reservoir 19 employing a pump 20 to direct such fluid from the reservoir 19 through a flexible delivery conduit 18 into the primary conduit 17 to project such fluid from outlet ports 16 mounted on the hand back surface 14, or alternatively may be projected through the palm surface 14 if so desired. Pump 20 per se is itself available such that the prior art provides such structure, wherein manual reciprocation of the pump shaft directs fluid from the reservoir into the associated flexible delivery conduit 18 from a nozzle mounted to the pump, such that the nozzle is received within the flexible delivery conduit 18 as illustrated.

Figure 4:
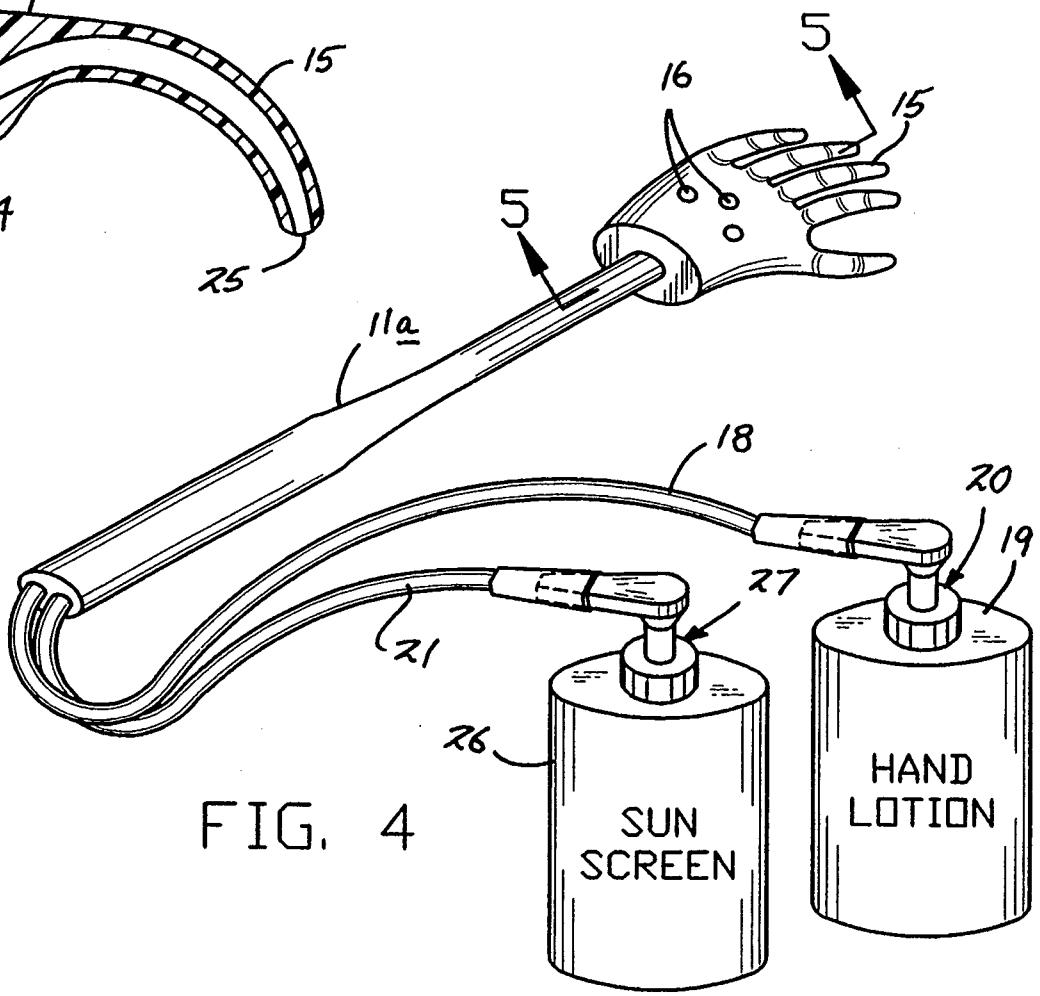
FIG. 4 is an isometric illustration of the invention employing a duality of reservoirs, each arranged to selectively direct fluid through the hand member.
Figure 5:
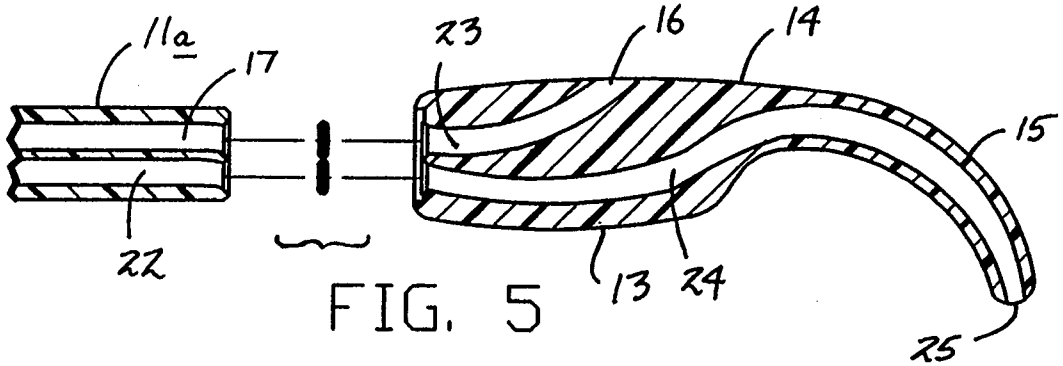
FIG. 5 is an orthographic view, taken along the lines 5—5 of FIG. 4 in the direction indicated by the arrows.

The FIGS. 4 and 5 indicate that a secondary delivery conduit 21 may be provided from a secondary reservoir 26, having a secondary pump 27, such that the secondary delivery conduit 21 directs fluid such as sunscreen lotion through a secondary conduit 22 (see FIG. 5) within a modified shaft la. The secondary conduit 22 directs such lotion through the fingertips or outer distal ends through secondary outlet ports 25 to direct such lotion onto an individual's back surface and the like.

The primary conduit, as illustrated in FIG. 5, is in fluid communication with the outlet port 16 through a first hand conduit relative to each of the outlet ports 16, with a second hand conduit 24 in fluid communication with the secondary conduit such that each of the secondary outlet ports 25 includes a second hand conduit 24, as illustrated in FIG. 5, to fluidly communication each of the secondary outlet ports with the secondary conduit 22.

Figure 6:
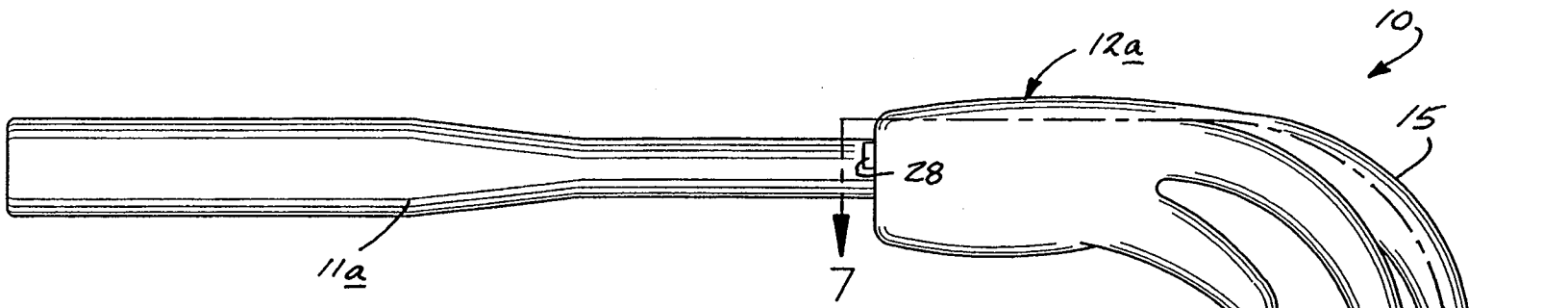
FIG. 6 is an orthographic side view of the invention employing oscillating finger construction.
Figure 7:
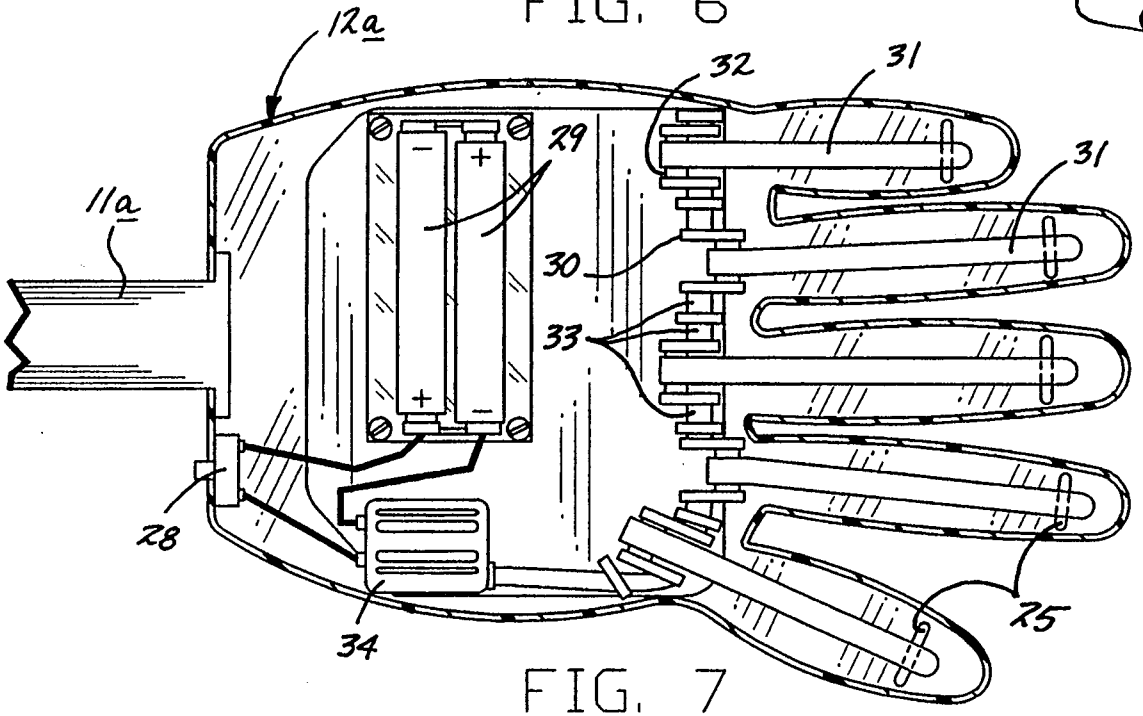
FIG. 7 is an orthographic view, taken along the lines 7—7 of FIG. 6 in the direction indicated by the arrows to illustrate the manner of finger oscillation employed by the invention.

The organization 10, as illustrated in FIGS. 6 and 7, includes oscillating fingers 15 to enhance massaging, such that an on/off switch 28 is operative through a battery member 29 and a drive motor 34. The drive motor is provided with an elongate flexible drive crank shaft 30 extending from the drive motor along the fingers 15 as they are mounted to a modified hand member 12a. The flexible drive crank shaft 30 is provided with support journals 33 and eccentrically oriented journals 32, such that the eccentrically oriented journals 32 mount a rod member 31 extending into an individual finger 15. In this manner, the fingers 15 of FIG. 7 are arranged to oscillate with the reciprocation of the rod members 31 to effect a massaging action upon an individual.

It is to be understood that while certain forms of the present invention have been illustrated and described herein, it is not to be limited to the specific forms or arrangement of parts described and shown.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed and desired to be protected by LETTERS PATENT of the United States is as follows:

1. A massage device, comprising, an elongate rigid shaft, the rigid shaft having a first end mounting a hand member thereon, the hand member having a first side to include a palm surface and a second side to include a back surface with the first side opposed to the second side, with the shaft having a primary conduit extending through the shaft in fluid communication with the hand member, such that the hand member includes a plurality of outlet ports extending from the hand member through the back surface, and a flexible delivery conduit extending from the shaft second end, a reservoir, the reservoir having a pump member, and the reservoir in fluid communication with the flexible delivery conduit, whereupon actuation of the pump member effects fluid flow through the primary conduit and the outlet ports, the hand member including a plurality of finger members extending from the hand member past the palm surface, and a secondary conduit through the elongate shaft, with the secondary conduit in fluid communication with the fingers members, with each of the finger members having a secondary outlet port in fluid communication with the secondary conduit, with each said secondary conduit outlet port directed through the second side of the hand member, and a secondary delivery conduit in fluid communication with the secondary conduit, and a secondary reservoir, the secondary reservoir having a secondary pump, with the secondary pump in fluid communication with the secondary delivery conduit.

2. A massage device as set forth in claim 1 wherein the hand member further includes a drive motor, at least one battery member, and an on/off switch to effect selective actuation of the drive motor by selective electrically communicating the drive motor with the battery member, and the drive motor having a flexible drive crank shaft extending from the drive motor and extending along the finger members, with the flexible drive crank shaft having rotatably mounted support journals, and a plurality of eccentrically oriented journals offset relative to the support journals, such that each of the finger members includes a rod member, and each said rod member is mounted to one of said eccentrically oriented journals, whereupon rotation of the flexible drive crank shaft effects oscillation of the finger members.

* * * * *